US008300382B2

(12) United States Patent
True et al.

(10) Patent No.: US 8,300,382 B2
(45) Date of Patent: Oct. 30, 2012

(54) PORTABLE TRANSFORMER WITH SAFETY INTERLOCK

(75) Inventors: William R True, McHenry, IL (US); Richard R Todd, Lemont, IL (US); Sharon C Huber, McHenry, IL (US)

(73) Assignee: Jack Jumper, LLC, McHenry, IL (US)

( * ) Notice: Subject to any disclaimer, the term of this patent is extended or adjusted under 35 U.S.C. 154(b) by 475 days.

(21) Appl. No.: 12/697,230

(22) Filed: Jan. 30, 2010

(65) Prior Publication Data

US 2011/0188167 A1 Aug. 4, 2011

(51) Int. Cl.
*H01H 9/28* (2006.01)

(52) U.S. Cl. ..... 361/269

(58) Field of Classification Search ..... 361/268, 361/269, 615

See application file for complete search history.

(56) References Cited

U.S. PATENT DOCUMENTS

| | | | | |
|---|---|---|---|---|
| 3,116,086 | A | 12/1963 | Barengoltz | |
| 3,273,053 | A * | 9/1966 | Allen et al. | 323/346 |
| 3,631,324 | A | 12/1971 | Jones | |
| 4,233,643 | A | 11/1980 | Iverson et al. | |
| 4,535,253 | A | 8/1985 | Ootsuka et al. | |
| 4,562,360 | A | 12/1985 | Fujimoto | |
| 6,233,137 | B1 * | 5/2001 | Kolos et al. | 361/603 |
| 6,696,925 | B1 | 2/2004 | Aiello, Jr. | |
| 6,770,810 | B2 | 8/2004 | Wiebe et al. | |
| 7,142,410 | B2 * | 11/2006 | Norris et al. | 361/603 |

FOREIGN PATENT DOCUMENTS

| | | | |
|---|---|---|---|
| CN | 1601836 | A | 3/2005 |
| ES | 2047444 | A2 | 2/1994 |
| FR | 2698737 | A1 | 6/1994 |

(Continued)

OTHER PUBLICATIONS

HVL 5-38 kV Load Interrupter Switchgear Brochure, Document No. 6040BR9401R12/02, Square D, Schneider Electric, Date of Publication: Dec. 2002.

(Continued)

*Primary Examiner* — Rexford Barnie
*Assistant Examiner* — Christopher Clark
(74) *Attorney, Agent, or Firm* — Patents and Licensing LLC; Daniel W. Juffernbruch

(57) ABSTRACT

A portable apparatus for voltage transformation is capable of temporarily augmenting a power transformer. A transformer with a first medium voltage primary winding, a second medium voltage primary winding and a low voltage secondary winding is selectably coupled to a plurality of medium voltage electrical power input couplings capable of temporarily coupling with medium voltage power on a plant. An interlocked switch selectably couples the medium voltage electrical power input couplings to the medium voltage primary windings of the transformer such that only one medium voltage primary winding of the transformer is coupled at a time to the medium voltage electrical power input couplings. The interlocked switch can use a captive key system to prevent more than one secondary winding from being simultaneously connected. Medium voltage circuit protection devices such as fuses are included. A low voltage circuit protection device, operatively coupled to the low voltage secondary windings, provides low voltage power. An interlocked couplings door lockably covers the medium voltage electrical power input couplings and a fuse door lockably covers the fuses such that no door can be unlocked when a medium voltage primary winding of the transformer is coupled to the medium voltage electrical power input couplings. The portable apparatus can be carried on a vehicular trailer.

20 Claims, 10 Drawing Sheets

FOREIGN PATENT DOCUMENTS

| | | | |
|---|---|---|---|
| JP | 59178912 | A | 10/1984 |
| JP | 4127807 | A | 4/1992 |
| JP | 6181125 | A | 6/1994 |
| JP | 8331712 | A | 12/1996 |
| JP | 10201019 | A | 7/1998 |
| JP | 10224921 | A | 8/1998 |
| JP | 2000208335 | A | 7/2000 |
| JP | 2007150056 | A | 6/2007 |
| WO | WO-03-063313 | | 7/2003 |

OTHER PUBLICATIONS

Transfer Equipment Used in Optional Standby Systems for Commercial Applications, Part I, The Fundamentals of Key Interlocks, by Chad Kennedy, IAEI News, May-Jun. 2009, pp. 72-76.

Siemens Power Circuit Breakers WL Manuals, Table of Contents, Catalog No. WLOPMAN1, cover sheets 1 and 2 and Table of Contents pp. I through V and pp. 9-1 through 9-129 inclusive, 136 pages total, WL_Operators_Manual_Section_9.pdf accessed Nov. 24, 2009.

Siemens Power Circuit Breakers WL Manuals, Table of Contents, Catalog No. WLOPMAN1, cover sheets 1 and 2 and Table of Contents pp. I through V and pp. 10-1 through 22-3 inclusive, 86 pages total, WL_Operators_Manual_Section_10_to_22.pdf accessed Nov. 24, 2009.

Siemens Power Circuit Breakers WL Manuals, Table of Contents, Catalog No. WLOPMAN1, cover sheet 1 and pages 19-1, 19-2 and 19-5, 4 pages total, WL_Operators_Manual_Section_19-1 19-2 19-5.pdf accessed Nov. 24, 2009.

* cited by examiner

PRIMARY 610

SECONDARY COIL 710

SINGLE PHASE PRIMARY COIL 991

SINGLE PHASE SECONDARY COIL 992

SECONDARY COIL 810

PORTABLE TRANSFORMER WITH SAFETY INTERLOCK

BACKGROUND OF THE INVENTIONS

1. Technical Field

The present inventions relate to transformers and, more particularly, relate to safetied transformers.

2. Description of the Related Art

Alternate power is needed during an electrical outage. Power transmission companies have used generators to bypass transformers or other devices that have become inoperative. Generators either feed the load that was lost during the outage or back-feed pole mounted transformers to repower the lines. Using generators causes excess CO2 and pollution from the exhaust. They have been subject to theft since they can be used anywhere a generator is needed, and were unable to be overloaded due to the sensitivity of their internal windings.

Temporary backup transformers have been mounted on trailers. However, they were extremely unsafe and unreliable even resulting in accidental death. Unlike generators, transformers have the ability to be temporarily overloaded for short periods of time. This was specifically useful when large motors are starting up such as the ones used on elevator systems. These transformers used oil for cooling which caused another hazard if the transformer failed. These transformers also changed voltage levels with large copper links that could be bolted across phases resulting in a direct short and large arc flash. These units were extremely dangerous and followed no standard of manufacture. They utilized live pole activated outdoor switches for the medium voltage sections and had no over-current protection provisions. This could lead to injury or death when not operated in a correct and safe manner.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

The details of the preferred embodiments will be more readily understood from the following detailed description when read in conjunction with the accompanying drawings wherein.

DETAILED DESCRIPTION OF THE PREFERRED EMBODIMENTS

A portable transformer system is needed capable of safe and reliable operation with little risk of electrocution including a way to configure multiple voltages safely.

An object of the invention is to provide an efficient practical apparatus of simple construction which will safely transform medium voltage electricity to a low voltage level utilizing a portable intent.

Another object of the invention is to provide isolation against hazardous voltages from the general public.

Another additional object of the invention is to provide a multitude of voltages with devices to interlock said voltages to inhibit cross connection and a hazardous condition.

A further object of the invention is to provide an efficient practical apparatus of simple construction which will be manufactured according to fixed mounted standards for dead front switchboard construction per Underwriters Laboratories listing 891.

A power transforming apparatus to replace or temporarily assist other transformers is provided with a plurality of inputs for incoming electrical power, covered and interlocked, a medium voltage disconnecting device located behind a dead front barrier, a voltage selector with device to prevent changing of voltage once energized, an interlock to prevent hazardous voltages from being exposed when the apparatus is in use, a plurality of outputs on a load side of a disconnecting device, a battery backup device for control of devices when unit is not in operation, and an assembly to cool and heat the enclosure. A preferred embodiment includes the input with a set of connectors or lugs.

Figure 1:
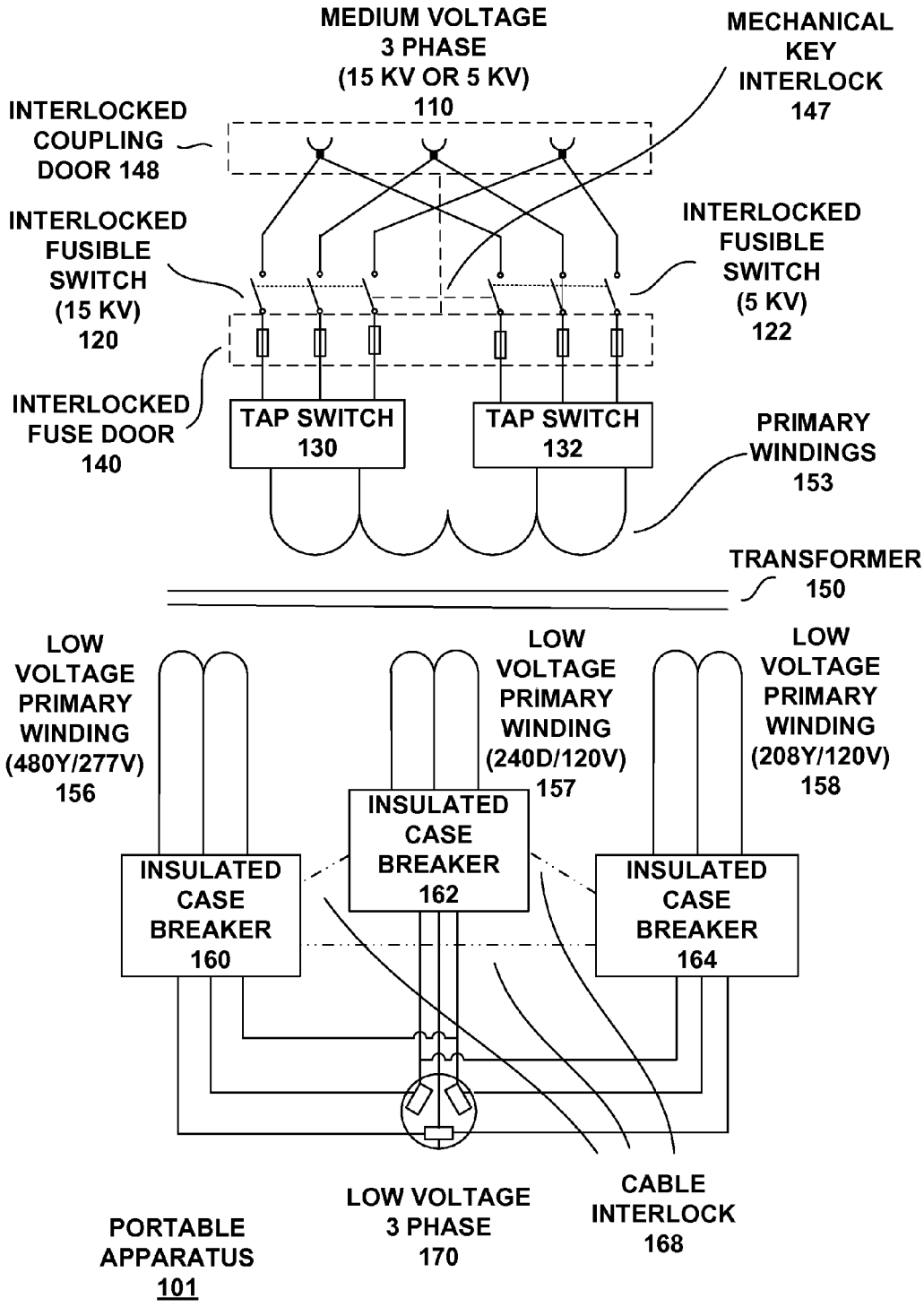
FIG. 1 illustrates a schematic block diagram of the components of a portable apparatus according to one three phase embodiment of the present inventions.

FIG. 1 illustrates a schematic block diagram of the electrical components of a portable apparatus 101 for voltage transformation according to one three phase embodiment. The portable apparatus 101 for voltage transformation is capable of temporarily augmenting or replacing or assisting a power transformer.

The portable apparatus for voltage transformation uses a transformer 150 to augment a power transformer such as temporality replacing a bad power transformer during troubleshooting or repairing or assisting a power transformer when extra capacity is needed. The portable apparatus 101 can be a trailer vehicle itself or a trailer can be used for portably transporting the portable apparatus.

A transformer 150 of the portable or mobile apparatus has one or more medium voltage primary windings 153 and one or more low voltage secondary winding 156, 157, 158. The transformer 150 connects the medium voltage end to a low voltage end and contains a medium voltage winding with several taps and a low voltage winding with several other taps. The transformer 150 is preferably a dry transformer for portable use but other kinds of transformers such as oil can be used as well.

The transformer 150 of the one illustrated preferred embodiment has a 12,470/4160 V primary winding with a 12,000/3,900 V accessible via winding taps via tap switches 130 and 132. Also 480Y/277 V AC, 208Y/120 V AC, and 240/120 V AC secondary windings provide the low voltage end. The transformer 150 of the preferred embodiment is custom wound by a provider such as Hammond Power Solutions Inc. The transformer 150 of the preferred embodiment has a coil thermostat.

A plurality of medium voltage electrical power input couplings 110 are provided for coupling to the medium voltage end of a power transformer to be augmented. The medium voltage electrical power input couplings 110 can be whatever plugs or lugs or other couplings a particular power company prefers for its system or are in current use by the power transformer to be augmented. Medium voltage electrical power input couplings 110 preferably use cable connectors such as 15,000 VAC class molded connectors. This way, utility companies can use their "hot sticks" to engage and disengage these temporary connections. In the preferred embodiment of FIG. 1 it is preferred to use 50 feet of High flex 15 kV class cable such as that made by TPC Wire & Cable Company.

Interlocked fusible switches 120 and 122 selectably connect one of the three phase medium voltages from the medium voltage couplings 110 to one of a plurality of primary windings on the transformer 150. Tap switches 130 and 132 are provided to trim the medium voltage selected by the interlocked fusible switches by further selecting taps on the plurality of windings. A mechanical interlock such as a captive key interlock 147 secures fusible switch 120 and fusible switch 122 to assure only one of the switches are closed at a time.

An interlocked coupling door 148 covers the medium voltage electrical power input couplings 110 in the one embodiment illustrated in FIG. 1. A mechanical key interlock such as a captive key interlock is used on the keyhole of the interlocked coupling door 148. When the mechanical key interlock 147 of the medium voltage switches 120 and 122 is shared with the interlocked coupling door 148, assurance is provided that the interlocked coupling door 148 is never open when a medium voltage switch 120 and 122 is closed.

An interlocked fuse door 140 covers the medium voltage fuses in the one embodiment illustrated in FIG. 1. A mechanical key interlock such as a captive key interlock is used on the keyhole of the interlocked fuse door 140. When the mechanical key interlock 147 is shared among all of the medium voltage switches 120 and 122, the interlocked coupling door 148 and the interlocked fuse door 140, assurance is provided that no more than one door is open at a time and no door is ever open when a medium voltage switch 120 or 122 is closed.

The portable apparatus of the present inventions can be adapted to different sources of medium voltage by selectably coupling the medium voltage to different primary windings. In the example of the preferred embodiment illustrated in FIG. 1 accommodates two medium voltage sources. These examples a first three phase medium voltage of fifteen kilovolt class (15 kV AC) and a second three phase medium voltage of five kilovolt class (5 kV AC).

Tap switches 130 and 132 selectably couple the interlocked fusible switches 120 and 122 to various winding taps on the medium voltage end of the transformer 150. Although the tap switches 130 and 132 do not need to be locked behind the doors because tap switches are typically designed to be operated safely, the tap switches 130 and 132 can still be located behind the doors for convenience or located in other places.

A plurality of the fusible switches 120 and 122 act as medium voltage circuit protection devices. The interlocked fusible switches 120 and 122 are operatively coupled between one of the medium voltage primary windings 153 and the medium voltage electrical power input coupling 110. The interlocked fusible switches 120 and 122 use electrical fuses that open on an over current condition.

Each interlocked fusible switch 120 and 122 is preferably made of a group of ganged medium voltage blade switches and corresponding separate primary fuses, as illustrated. The medium voltage blade switches permit a direct drive operator to operate and touch the switches only when an outside exterior door (not illustrated) is open. The medium voltage blade switches are preferably made by Square D by Schneider Electric and U.L. Listed. The medium voltage blade switches preferably have separate paths for current and arcing and provide HVL Arc chutes for arc interruption when operated. The medium voltage blade switches are preferable disposed in a CS-3 fuse configuration, though other configurations are also desirable.

Each medium voltage blade switch has a separate primary fuse. The primary fuses are preferably a CS-3 style, plug in type, current limiting fuse by Ferraz Shwmut and U.L. Listed. The primary fuses are also preferably non venting with a visible blown fuse indication and its catalog number embossed on metal housing for simple replacement.

A door with a key interlock covers the medium voltage electrical power input couplings 110 on the top of the unit. The components behind the medium voltage exterior door in the preferred embodiment of FIG. 1 are the interlocked fusible switches 120 and 122 and the tap switches 130 and 132.

The door in the embodiment of FIG. 1 is a door to the medium voltage fuse compartment 140. The door to fuse compartment 140 causes the medium voltage from the medium voltage interlocked switches 120, 122 to be disconnected whenever the door is open. The fuse compartment door is interlocked with the coupling door and the medium voltage switch operators by a captive key system. An example of a fuse door to dead front switch in one embodiment is the Square D HVL 5-38 kV Load Interrupter Switchgear by Schneider Electric which incorporates an interlock system.

On the medium voltage end of the portable transformer trailer, behind one or more interlocked doors, the medium voltage components are accessible to the user. The components behind the medium voltage fuse compartment door in the preferred embodiment of FIG. 1 are the fuse clips or mounting means for changing a spent fuse.

The door to dead front fuse compartment 140 causes a key interlock such as a captive key interlock 147 to open the blade switches of the interlocked fusible switches 120 and 122 whenever the door is opened. The door to dead front fuse compartment 140 preferably follows the interior guidelines of the Underwriters Laboratories 891 listing for dead front switchboard construction.

A mechanical key interlock 147 has keyholes on the interlocked coupling door 148 and on the interlocked fuse door 140, and on each of the interlocked fusible switches 120 and 122. The mechanical key interlock 147 is preferably a captive key system to prevent medium voltage electrical power input couplings from being altered while in use. One example of such a captive key system is a MV Kirk brand key interlock. Such mechanical key interlock 147 is represented also by the illustration of the dotted lines in FIGS. 1 and 2 at 147 and 247.

In a captive key system there is more than one keyhole and each keyhole requires the same key. And, in a captive key system, only one key is made available to users. In a key interlock system each keyhole can not be turned without the key and the key can not be removed from a keyhole without being turned back. Thus only one keyhole can be turned at a time and no others turned if one is turned. That way there is assurance that no more than one electrical function is activated and no door is open when an electrical function is activated.

If a door is open when an electrical function is activated, a human user would be able to touch the medium voltage electrical power input couplings and any other electrical components behind the dead front door, exposing the user to risk of death by electrical current shock from the exposed medium voltages. The captive key system makes portable apparatus feasible because it helps eliminate this risk.

If more than one medium voltage was activated at the same time, there could be highly dangerous cross-over voltages on the primary windings of the transformer and incorrect voltages on the secondary windings. Also medium voltages could be unknowingly back fed to an electrical plant causing risk of death. The captive key system makes portable apparatus feasible because it helps eliminate these risks.

There is also assurance that no more than one door is open at a time in addition to no electrical function being activated when a door is open. If more than a one door was open at the same time, there could be problems if the primary couplings were connected energizing the line end of the medium voltage switch which could also cause risk of death.

In the exemplary embodiment illustrated in FIG. 1, multiple primary windings 153 and multiple secondary windings 156, 157, 158 are illustrated for flexible convenience of selecting different voltages. The portable apparatus of the present invention does not need to have the convenience of this flexibility and only one primary winding 153 and only one secondary winding is needed. It is also possible to have multiple primary and one secondary or one primary winding and multiple secondary windings, depending on the desired flexibility. Taps to the transformer can be placed between windings to cause one winding to become two windings.

Although the portable apparatus of the preferred embodiments of the present invention accommodates three phase electrical power, it can be configured for connection to both three phase and two phase systems by an operator hooking it up without the third phase. This is referred to as an open wye or open delta configuration. In alternate embodiments, equipment can be made that accommodates just single phase for certain applications or environments as will be described with reference to FIG. 2.

Figure 2:
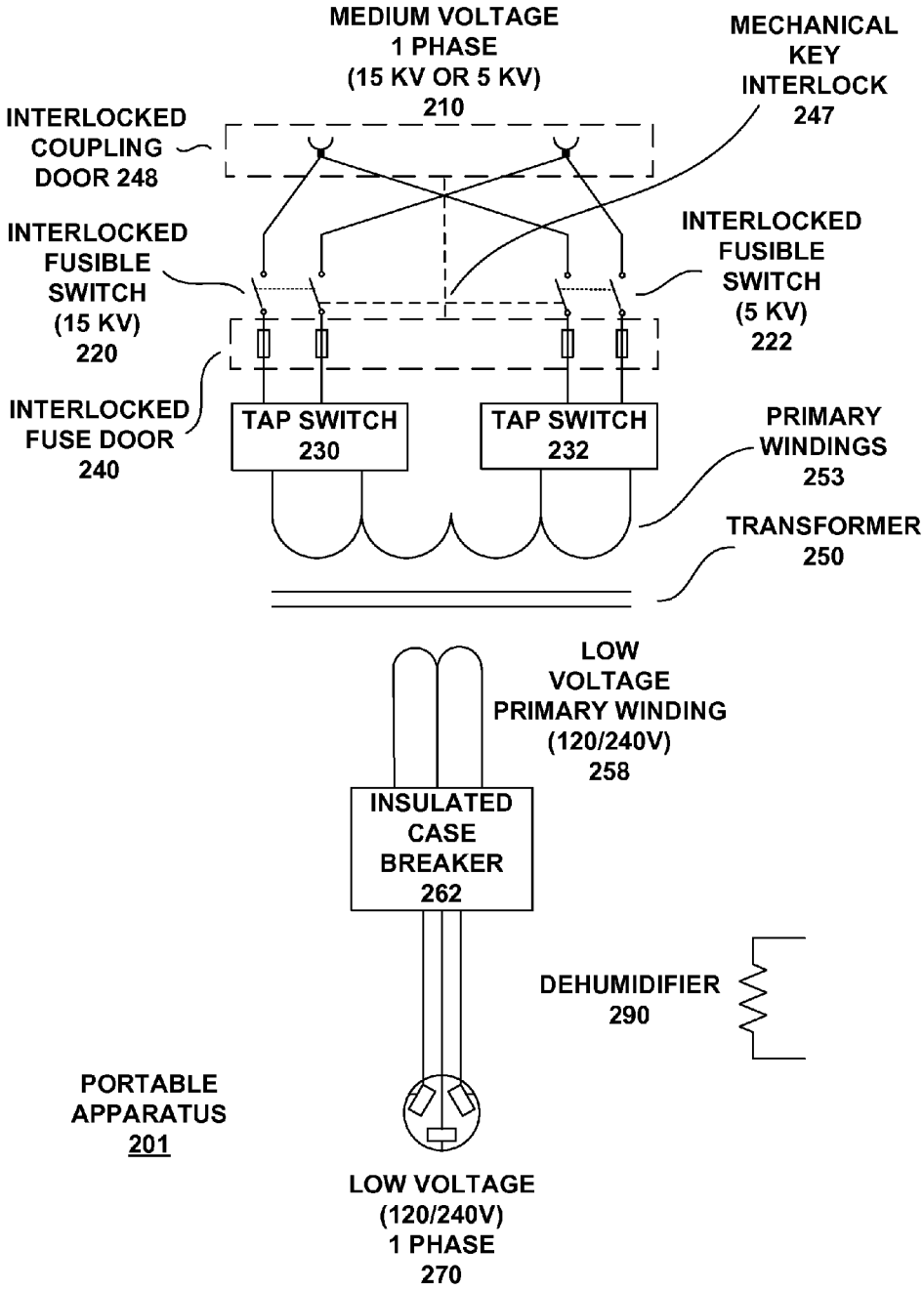
FIG. 2 illustrates a schematic block diagram of the components of a portable apparatus according to one single phase embodiment of the present inventions.

In the exemplary embodiment illustrated in FIG. 1, portable apparatus for augmenting a three phase transformer is illustrated. Multiple windings or taps are typically used to accommodate three phase as illustrated. The portable apparatus of the present invention does not need to accommodate three phases and windings for a two phase system can be used. FIG. 2 will illustrate a single phase system with a selectable medium voltage. It is also possible to build one portable apparatus with a transformer and other components that are selectable between a three phase system and a single phase system. Commercially today this does not have as much utility and such is not illustrated. One would build a portable apparatus that is selectable between a three phase system and a single phase system as follows. A specially made transformer would use three single phase transformers with one transformer approximately three times the kilovolt amperes as the other two. A special high amperage selector switch would be able to switch between the two configurations.

For flexible convenience and a choice of different medium voltages, according to the embodiment illustrated in FIG. 1, the transformer 150 has a first and second medium voltage primary windings. The interlocked fusible switches 120 and 122 selectively couple at least one of the first and second medium voltage primary windings 153. An operator operates the interlocked fusible switches 120 and 122 to match the medium voltage of a plant attached to the medium voltage electrical power input couplings 110.

Insulated case breakers 160, 162 and 164 are connected to low voltage secondary windings 156, 157 and 158. The insulated case breakers 160, 162 and 164 are set to break connection when a sensed low voltage current is too high.

Although only one secondary winding and breaker is needed at a time, for flexible convenience and a choice of different low voltages, according to the embodiment illustrated in FIG. 1, the transformer has a plurality of low voltage secondary windings 156, 157 and 158. The insulated case breakers 160, 162 and 164 are each associated with respective ones of the plurality of low voltage secondary windings 156, 157 and 158. Any low voltage breaker can be used, though insulated case breakers are illustrated in the embodiment of FIG. 1. The low voltage breakers 160, 162 and 164 are operatively coupled to the low voltage secondary windings to provide low voltage power to an output such as the low voltage, three phase outlet 170 illustrated in FIG. 1.

When more than one insulated case breaker 160, 162 and 164 is used, a low voltage interlock 168 is preferably coupled between the plurality of low voltage breakers to prevent more than one breaker from being engaged simultaneously. The low voltage interlock in one example construction can preferably have a mechanical cable interlock 168 coupled between the plurality of low voltage breakers.

The low voltage end of the portable transformer trailer is preferably behind a locked door with a tamper switch for remote alerting. The low voltage components behind the locked door in the preferred embodiment of FIG. 1 are the insulated case breakers 160, 162 and 164. The low voltage outlets are located on the top or side of the unit behind a separate locked door. The low voltage load connector 170 is preferably located under a locked door with a tamper switch for remote alerting. The low voltage load connector 170 in the example of the embodiment of FIG. 1 accommodates three phase power at a selected one of several low voltages depending on which insulated case breaker is closed to one of the plurality of secondary windings. All unused load connectors preferably have covers over them so unused receptacles do not become a hazard.

The low voltage end of the transformer 150 in one embodiment has interlocked insulated case circuit breakers 160, 162 and 164 preferably with Modbus RS-485 communication capabilities. The interlocking of the circuit breakers can be accommodated electronically on the low voltage end via bidirectional bus. A mechanical interlock could also be used on the low voltage end in an alternate embodiment of several reasons such as in the event high tech regulators were unneeded. The interlocking prevents more than one low voltage circuit breaker from being closed at the same time.

Insulated case circuit breakers 160, 162 and 164 preferably are upgradeable trip units having a contact erosion indicator, ready to close indicator, and mechanical interlock and communications capable via Modbus. Insulated case circuit breakers 160, 162 and 164 in the preferred embodiment are Power Circuit Breakers, type WL made by Siemens. A circuit breaker can be locked in the off position and a Rogowski Coil provides 1% metering grade accuracy. The low voltage breakers preferably connect to a horizontal silver plated copper bus stack which will feed temporary power connections such as cam type connectors.

FIG. 2 illustrates a schematic block diagram of the electrical components of a portable apparatus 201 for voltage transformation according to one single phase embodiment. The portable apparatus 201 for voltage transformation is capable of temporarily augmenting or replacing or assisting a power transformer.

The portable apparatus for voltage transformation uses a transformer 250 to augment a power transformer such as temporality replacing a bad power transformer during troubleshooting or repairing or assisting a power transformer when extra capacity is needed. The portable apparatus 201 can be a trailer vehicle itself or a trailer can be used for portably transporting the portable apparatus.

A transformer 250 of the portable apparatus of the one exemplary embodiment of FIG. 2 has one or more medium voltage primary windings 253 and one low voltage secondary winding 258. The transformer 250 connects the medium voltage end to a low voltage end and contains a medium voltage winding with several taps and a low voltage winding.

The transformer 250 of the preferred embodiment has a 7,200/2,400 V primary winding with a 6,900/2,160 V accessible via winding taps via tap switches 230 and 232. A 240/120 V secondary winding provides the low voltage end.

A plurality of medium voltage electrical power input couplings 220 are provided for coupling to the medium voltage end of a power transformer to be augmented. The medium voltage electrical power input couplings 220 can be whatever plugs or lugs or other couplings a particular power company prefers for its system or are in current use by the power transformer to be augmented.

Fusible switches 220 and 222 connect single phase medium voltages to tap switches 230 and 232. A mechanical interlock such as a captive key interlock 247 couples between fusible switch 220 and fusible switch 222 to insure only one switch can be closed at any given time.

Tap switches 230 and 232 selectably couple the fusible switches 220 and 222 to various winding taps on the medium voltage end of the transformer 250.

A plurality of the fusible switches 220 and 222 acts as medium voltage circuit protection devices. A fusible switch 220 and 222 is operatively coupled between one of the medium voltage primary windings 253 and the medium voltage electrical power input coupling 220. The fusible switches 220 and 222 use electrical fuses that open on an over current condition.

The medium voltage blade switches permit a direct drive operator to operate and touch the switches only when the exterior door is open.

Each fusible switch 220 and 222 is preferably made of a medium voltage blade switch and a separate primary fuse.

A door covers the medium voltage electrical power input couplings 220 on the top of the unit. The components behind the medium voltage exterior door in the preferred embodiment of FIG. 2 are the fusible switches 220 and 222 and the tap switches 230 and 232.

The door in the embodiment of FIG. 2 is a fuse compartment door 240. The door to fuse compartment 240 causes the medium voltage fusible switches 220 and 222 to be in the off position wherever the door is open. The door is interlocked.

On the medium voltage end of the portable transformer trailer, behind one or more interlocked doors, the medium voltage components are accessible to the user. The components behind the medium voltage exterior door in the preferred embodiment of FIG. 2 are the fusible switches 220 and 222 and tap switches 230 and 232. Selectable medium voltages expand usability of the portable transformer trailer. The fuse compartment doors on the medium voltage end of the portable transformer trailer use a key interlock so that they can not be opened without a key.

A mechanical key interlock 247 is operatively coupled between the medium voltage electrical power input couplings 220 and the medium voltage fusible switches 220 and 222 for opening the connection when the fuse compartment door 240 is open. The interlock is preferably a captive key system to prevent medium voltage electrical power input couplings from being altered while in use. One example of such a captive key system is a MV Kirk brand key interlock. Such mechanical key interlock 247 is represented also by the illustration of the dotted lines in FIG. 2 at 247.

In the exemplary embodiment illustrated in FIG. 2, multiple primary windings 153 and one secondary winding 258 are illustrated for flexible convenience of selecting different voltages. The portable apparatus of the present invention does not need to have the convenience of this flexibility and only one primary winding 253 is needed. It is also possible to have multiple primary and multiple secondary or one primary winding and multiple secondary windings, depending on the desired flexibility. Taps to the transformer can be placed between windings to cause one winding to become two windings.

Insulated case breaker 262 is connected to low voltage secondary winding 258. The insulated case breaker 262 is set to break connection when a sensed low voltage current is too high.

The low voltage end of the portable transformer trailer is preferably behind a locked door with a tamper switch for remote alerting. The low voltage components behind the locked door in the embodiment of FIG. 2 are the insulated case breaker 262. The low voltage connectors 270 are behind an additional locked door on the rooftop of the trailer with a tamper switch for remote alerting. The low voltage load connector 270 in the example of the embodiment of FIG. 2 accommodates single phase power at one-hundred twenty volts and two-hundred forty volts (120/240 V AC).

A dehumidifier 290 is contained in the portable apparatus to eliminate condensation when idle. A preferred dehumidifier heats an idle enclosure of the portable apparatus using a resistive heater. A resistive heater 290 is convenient since electrical power is usually nearby in the typical environment of a portable apparatus, even during storage.

The portable apparatus in the preferred embodiment is preferably housed in a self-contained transformer trailer such as will later be described and illustrated with reference to FIGS. 11-13

Figure 3:
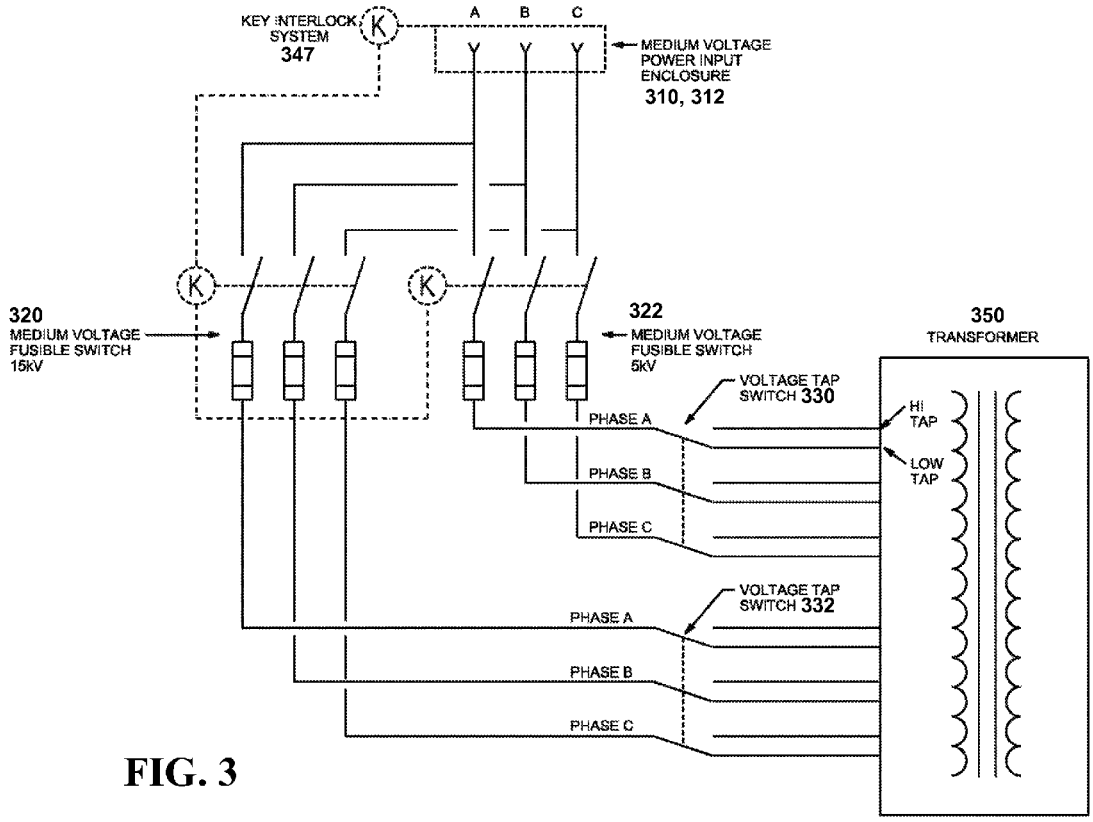
FIG. 3 illustrates a detailed schematic block diagram of components on a medium voltage end of a portable apparatus according to one three phase embodiment of the present inventions.

FIG. 3 illustrates a detailed schematic block diagram of electrical components on a medium voltage end of a portable apparatus according to one three phase embodiment. A key interlock 320 on keyholes to medium voltage fusible switches 320 and 322 prevents more than one medium voltage switch from being closed at the same time. A key interlock 347 on a keyhole to a door to a medium voltage power input enclosure 310, 312 covers medium voltage couplings. The medium voltage fusible switches 320 and 322 determine which primary winding of a transformer 350 is coupled to the medium voltage input couplings. By providing more than one selectable medium voltage input coupling, the portable apparatus of the present inventions can accommodate more than one medium voltage at the input couplings 310, 312. Voltage tap switches 330 and 332 are used to trim the voltage to compensate for line variances and voltage drops on lines.

Figure 4:
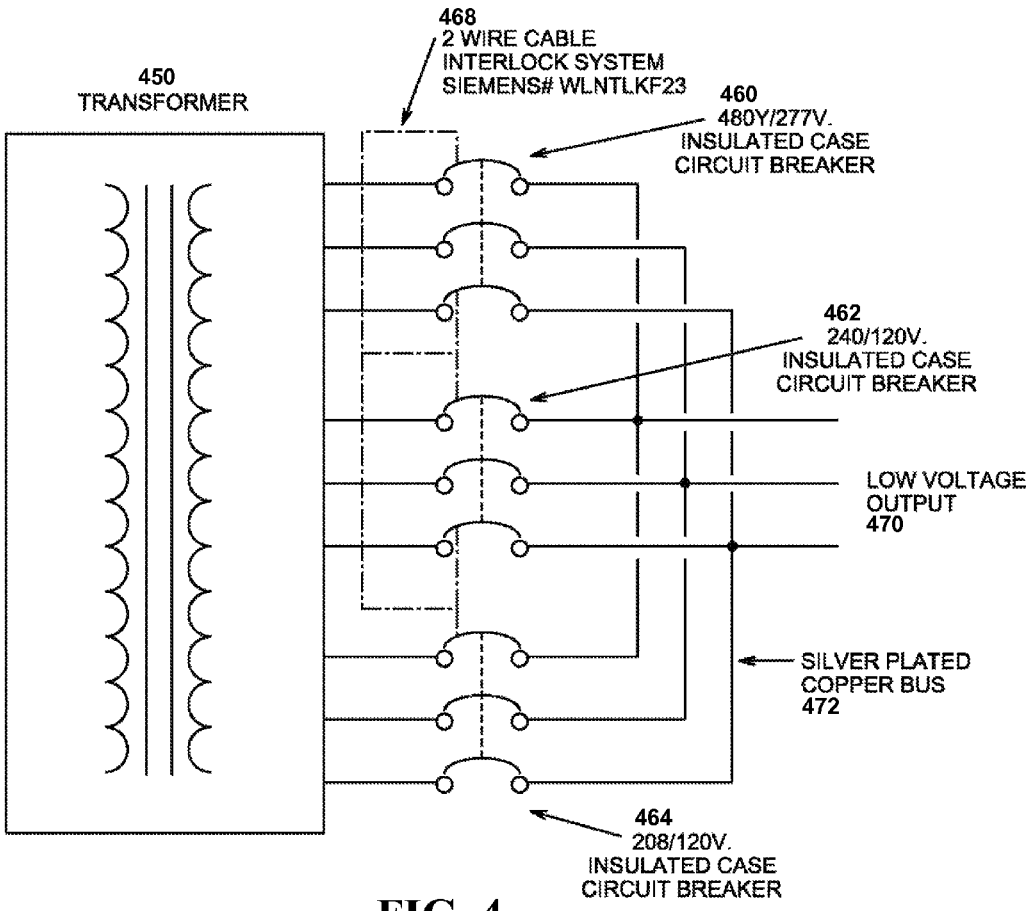
FIG. 4 illustrates a detailed schematic block diagram of components on a low voltage end of a portable apparatus according to one three phase embodiment of the present inventions.

FIG. 4 illustrates a detailed schematic block diagram of electrical components on a low voltage end of a portable apparatus according to one three phase embodiment. Insulated case breakers 460, 462 and 464 are illustrated coupled to corresponding secondary windings of the transformer 450 of the portable apparatus. The plurality of breakers 460, 462 and 464 accommodate different low voltage output needs by permitting selection of one of a plurality of different secondary windings of the transformer 450 to provide a desired low voltage output 470 over a silver plated copper bus 472. The breakers 460, 462 and 464 have an interlock 468 to assure no more than one breaker is on at a time. The interlock on the breakers is preferably a two wire cable interlock system usable with breaker part number WLNTLKF23 by Siemens.

Figure 5:
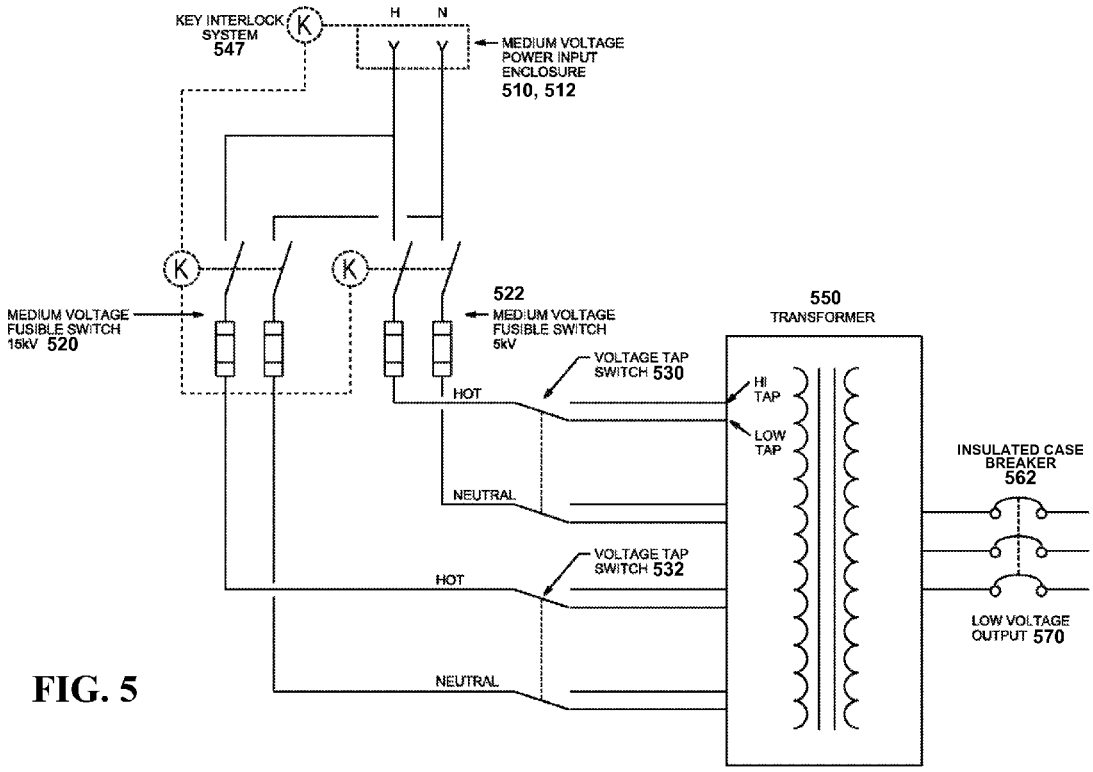
FIG. 5 illustrates a detailed schematic block diagram of components of a portable apparatus according to one single phase embodiment of the present inventions.

FIG. 5 illustrates a detailed schematic block diagram of electrical components of a portable apparatus according to one single phase embodiment of the present inventions. A key interlock 520 on keyholes to medium voltage fusible switches 520 and 522 prevents more than one medium voltage switch from being closed at the same time. A key interlock 547 on a keyhole to a door to a medium voltage power input enclosure 510 512 covers medium voltage couplings. The medium voltage fusible switches 520 and 522 determine which primary winding of a transformer 550 is coupled to the medium voltage input couplings. By providing more than one selectable medium voltage input coupling, the portable apparatus of the present inventions can accommodate more than one medium voltage at the input couplings 510, 512. Voltage tap switches 530 and 532 are used to trim the voltage to compensate for line variances and voltage drops on lines. Insulated case breaker 562 is illustrated coupled to a secondary winding of the transformer 550 of the portable apparatus to provide a low voltage output 570.

Figure 6:
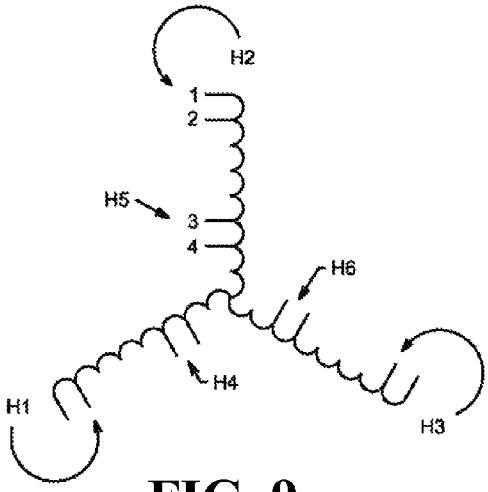
FIG. 6. illustrates a schematic drawing of an exemplary primary coil winding for a transformer useful according to one three phase embodiment according to an embodiment of the present inventions.
Figure 7:
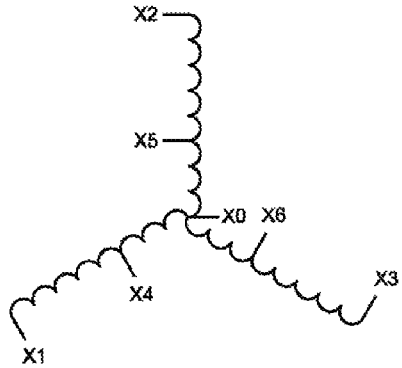
FIG. 7. illustrates a schematic drawing of an exemplary secondary coil winding for a transformer useful according to one three phase embodiment of the present inventions.
Figure 8:
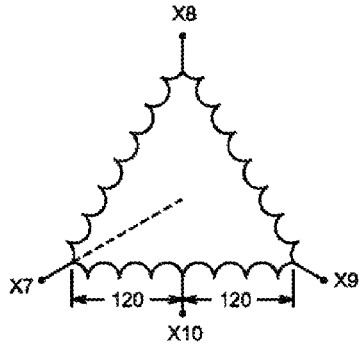
FIG. 8. illustrates a schematic drawing of another exemplary secondary coil winding for a transformer useful according to one three phase embodiment of the present inventions.

FIGS. 6, 7 and 8 illustrate schematics of exemplary windings for a transformer in one three phase embodiment. A primary coil winding 610, a first, secondary coil winding 710 and a second, secondary coil winding 810 are used for an exemplary three phase transformer.

FIG. 6. illustrates the primary coil winding 610 for coupling to three phase medium voltage components, such as those of FIG. 1 or 3. Connections to the exemplary primary windings 610 of FIG. 6 in one three-phase embodiment to the medium voltage components of FIG. 1 or 3 are described in the following TABLE 1:

TABLE 1

| Primary volts | Connect Lines to | Interconnect |
|---|---|---|
| 12470 | H1, H2, H3 | 1 |
| 12000 | H1, H2, H3 | 2 |
| 4160 | H4, H5, H6 | 3 |
| 3900 | H4, H5, H6 | 4 |

FIG. 7 illustrates a secondary coil winding 710 for coupling to three phase low voltage components, such as those of FIG. 1 or 4.

FIG. 8 illustrates a second secondary coil winding 810 for coupling to three phase low voltage components, such as those of FIG. 1 or 4.

Connections to the exemplary secondary windings 710 and 810 of FIGS. 7 and 8 in one three-phase embodiment to the low voltage components of FIG. 1 or 4 are described in the following TABLE 2:

TABLE 2

| Secondary Volts | Connect Lines to |
|---|---|
| 480Y/277 | X1, X2, X3, X0 |
| 208Y/120 | X4, X5, X6, X0 |
| 240D/120 | X7, X8, X9, X10 |

Figure 9:
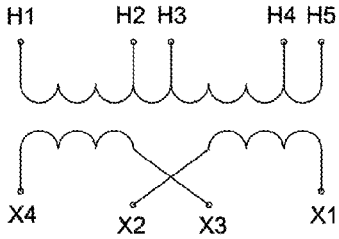
FIG. 9. illustrates a schematic drawing of both an exemplary primary coil winding and an exemplary secondary coil winding for a transformer useful according to one single phase embodiment of the present inventions.

FIG. 9. illustrates a detailed schematic drawing of both an exemplary primary coil winding and an exemplary secondary coil winding for a transformer useful according to one single phase embodiment of the present inventions. A primary coil winding 991 and a secondary coil winding 992 are used for an exemplary single phase transformer. The primary coil winding 991 couples to single phase medium voltage components, such as those of FIG. 2 or 5. The secondary coil winding 992 couples to single phase low voltage components, such as those of FIG. 2 or 5.

Connections to the exemplary windings 991 in one single phase embodiment to the medium voltage components of FIG. 2 or 5 are described in the following TABLE 3:

TABLE 3

| Primary volts | Connect Lines to |
|---|---|
| 7200 | H1, H5 |
| 6900 | H1, H4 |
| 2400 | H1, H3 |
| 2160 | H1, H2 |

Connections to the exemplary windings 992 in one single phase embodiment to the low voltage components of FIG. 2 or 5 are described in the following TABLE 4:

TABLE 4

| Secondary Volts | Connect Lines to | Interconnect |
|---|---|---|
| 120/240 | X1, X2, X4 | X2-X3 |

Figure 10:
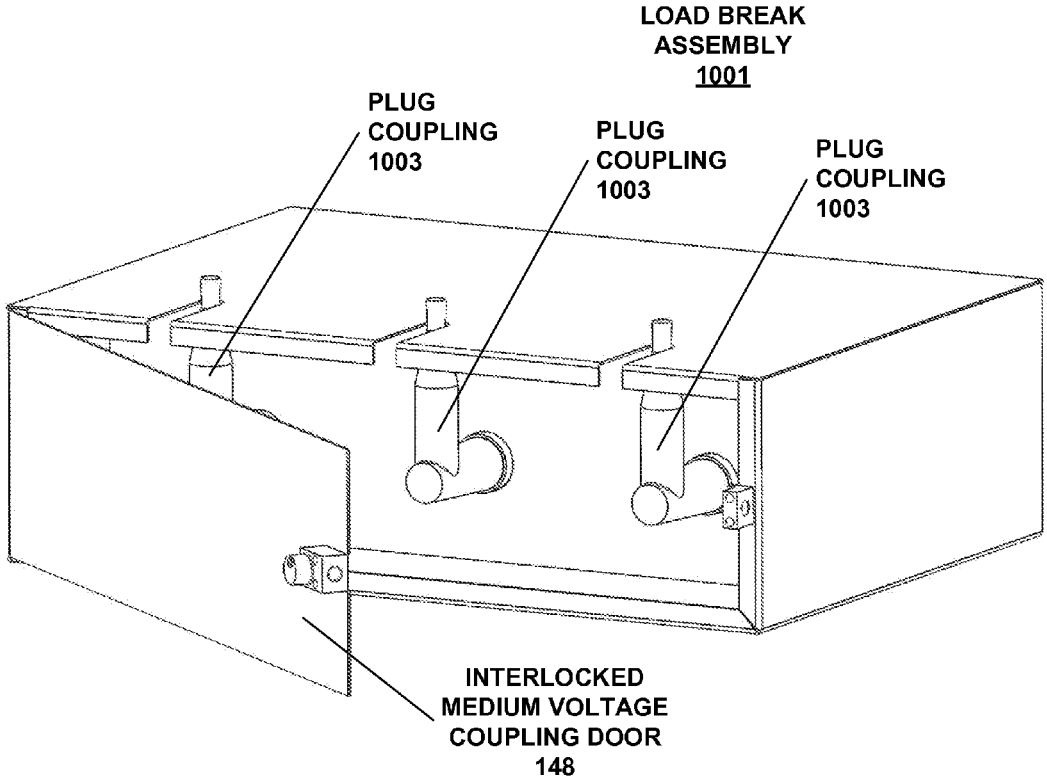
FIG. 10 illustrates a view of a load break assembly according to an embodiment of the present inventions.

FIG. 10 illustrates a view of a load break assembly 1001 according to an embodiment of the present inventions. Three plug couplings 1003 illustrate couplings for a three phase medium voltage connection to the plant of an electrical utility company. These are the plugs for the incoming medium voltage leads to supply power to the portable apparatus. The plug couplings 1003 of FIG. 10 illustrate an example of the medium voltage electrical power input couplings 110. A mechanical key interlock is illustrated in FIG. 10 on the door to the load break assembly 1001 according to an embodiment of the present inventions.

Figure 11:
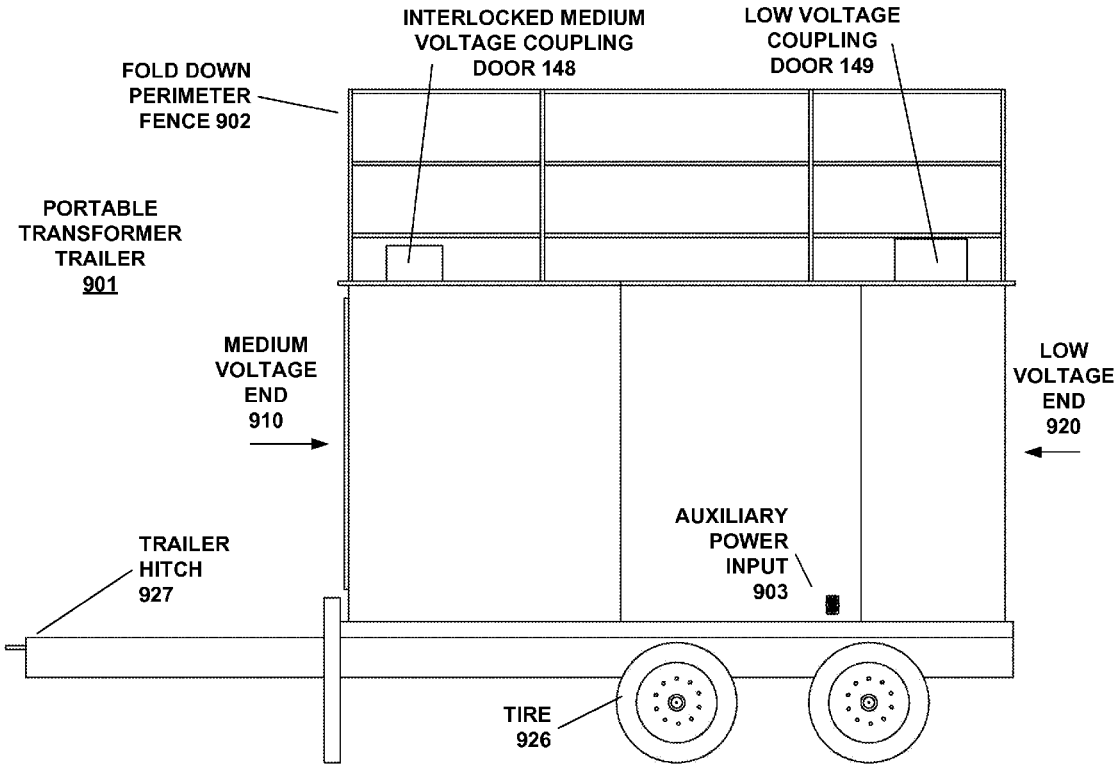
FIG. 11 illustrates a side view of the portable apparatus on a trailer for portably transporting the portable apparatus according to an embodiment of the present inventions.

FIG. 11 illustrates a side view of the portable apparatus on a trailer 901 for portably transporting the portable apparatus with transformer according to an embodiment of the present inventions. The trailer is pulled on wheels such as tire 926 by trailer hitch 927. The vehicular trailer portably transports the portable apparatus. An interlocked medium voltage coupling door 148 and a low voltage coupling door 149 are illustrated at the roof of the trailer in the embodiment of FIG. 11. The portable transformer trailer 901 is constructed with a 48" high perimeter fence around the top of the trailer. In FIG. 11 the fence is illustrated in an up position. This fence can fold down when unneeded for driving with the trailer vehicle. Also provided are two aluminum cable support poles, a 20 A GFCI convenience outlet, and an auxiliary power input 903. The auxiliary power input 903 is preferably a 20 A Edison inlet. The auxiliary power input 903 can be used to power an onboard battery charger, battery powered LED Perimeter lights, and a dehumidifier, among other auxiliary items, when the couplings are disconnected from utility lines.

In the preferred embodiment of the portable transformer trailer, medium voltage end 910 and low voltage end 920 oppose one another. Each opposing end of the trailer has overlaying exterior doors (not shown) with pad lockable handles. The exterior doors follow the guidelines of the Underwriters Laboratories 891 listing. In one embodiment as illustrated, the medium voltage switches, the medium voltage coupling door and the medium voltage fuse compartment doors use a mechanical key interlock such as a captive key interlock to assure no more than one medium voltage switch is closed at a time and no door is open when a medium voltage switch is closed.

The medium voltage end 910 of the transformer trailer will be described and illustrated with reference to FIG. 12 and the low voltage end 920 will be described and illustrated with reference to FIG. 13. These opposing ends of the trailer each have the overlaying exterior doors (not shown) with pad lockable handles.

Figure 12:
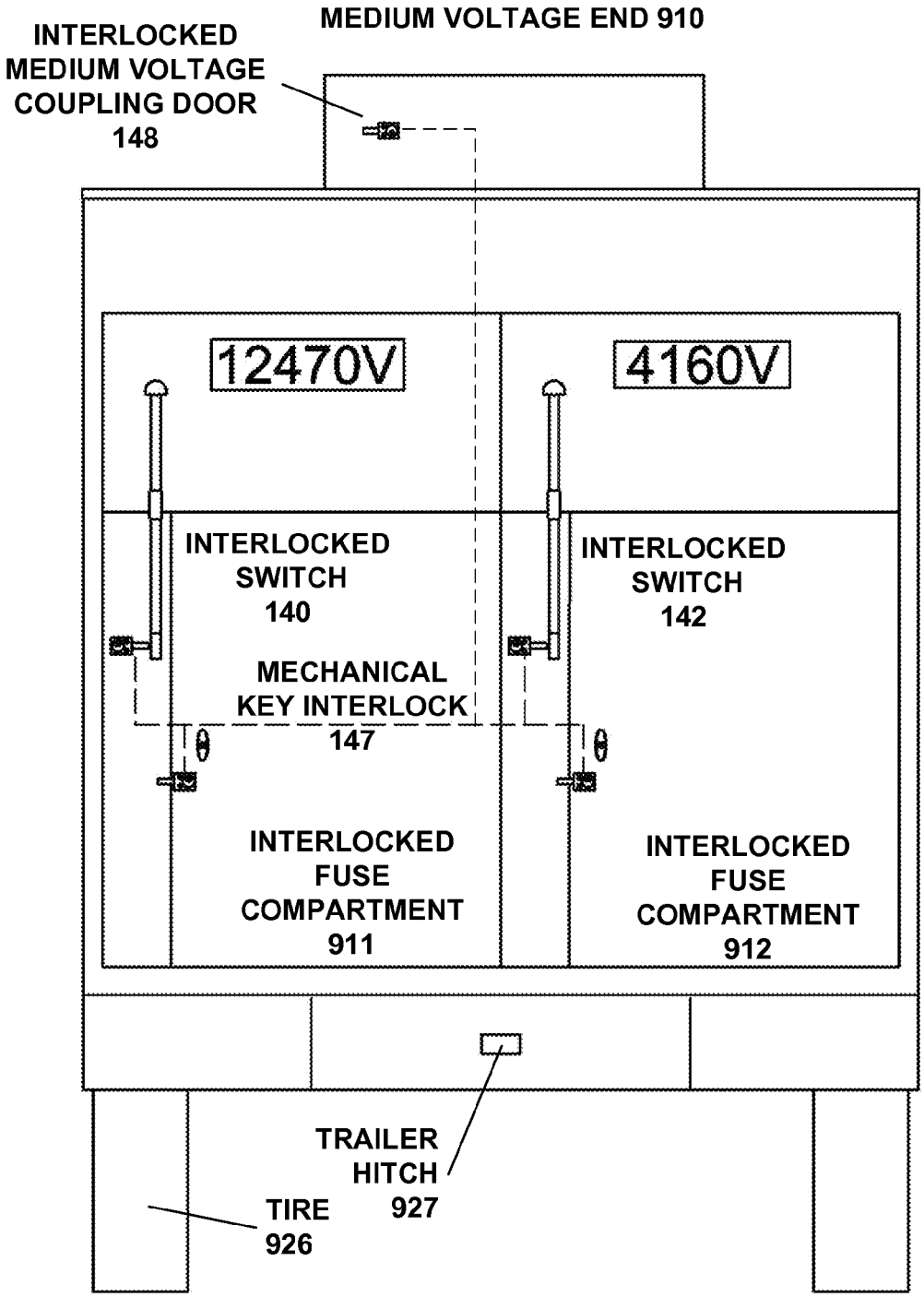
FIG. 12 illustrates a view of doors on a medium voltage end of a housing for the portable apparatus according to an embodiment of the present inventions.

FIG. 12 illustrates a view of doors on the medium voltage end of a housing for the portable apparatus according to an embodiment of the present inventions. A mechanical key interlock 147 is illustrated on the keyholes of medium voltage interlocked switches 140 and 142 to assure no more than one switch is closed at a time. The mechanical key interlock 147 is also illustrated on the keyhole of an interlocked medium voltage coupling door 148 and on the keyholes of medium voltage fuse compartment doors 911 and 912 to assure no door is open when a medium voltage switch 140 or 142 is closed. The dashed line shows the path a key will travel when a user turns only one keyhole at a time. Levers for two medium voltage switches 140 and 142 are illustrated, corresponding to a respective different medium voltage coupling of each switch compartment. Medium voltage fuse compartments are provided behind the interlocked fuse compartment doors 911 and 912. The trailer is pulled on wheels such as tire 926 by trailer hitch 927.

The interlocked medium voltage switches 140 and 142 in one embodiment are blade switches. These blade switches can have fuses attached thereto behind the interlocked fuse compartments 911 and 912. In one alternative embodiment, the interlocked medium voltage switches 140 and 142 can utilize a mechanical device therebetween such as a cable or bar to provide the interlock to assure no two medium voltage switches are closed at the same time. In such one alternative embodiment a mechanical key interlock would not be needed for the switch safety interlock but might still be utilized even on the switch to assure doors are unopened when any medium voltage switch is closed.

Advanced metering can be provided behind the low voltage door by a Siemens 9510 advanced power meter. Potential transformers are used to get primary voltage information. The medium voltage switch status can be monitored on its screen. Information and a log of each breaker's trip unit can be compiled up to 30 days of events with customizable web pages for remote viewing.

Figure 13:
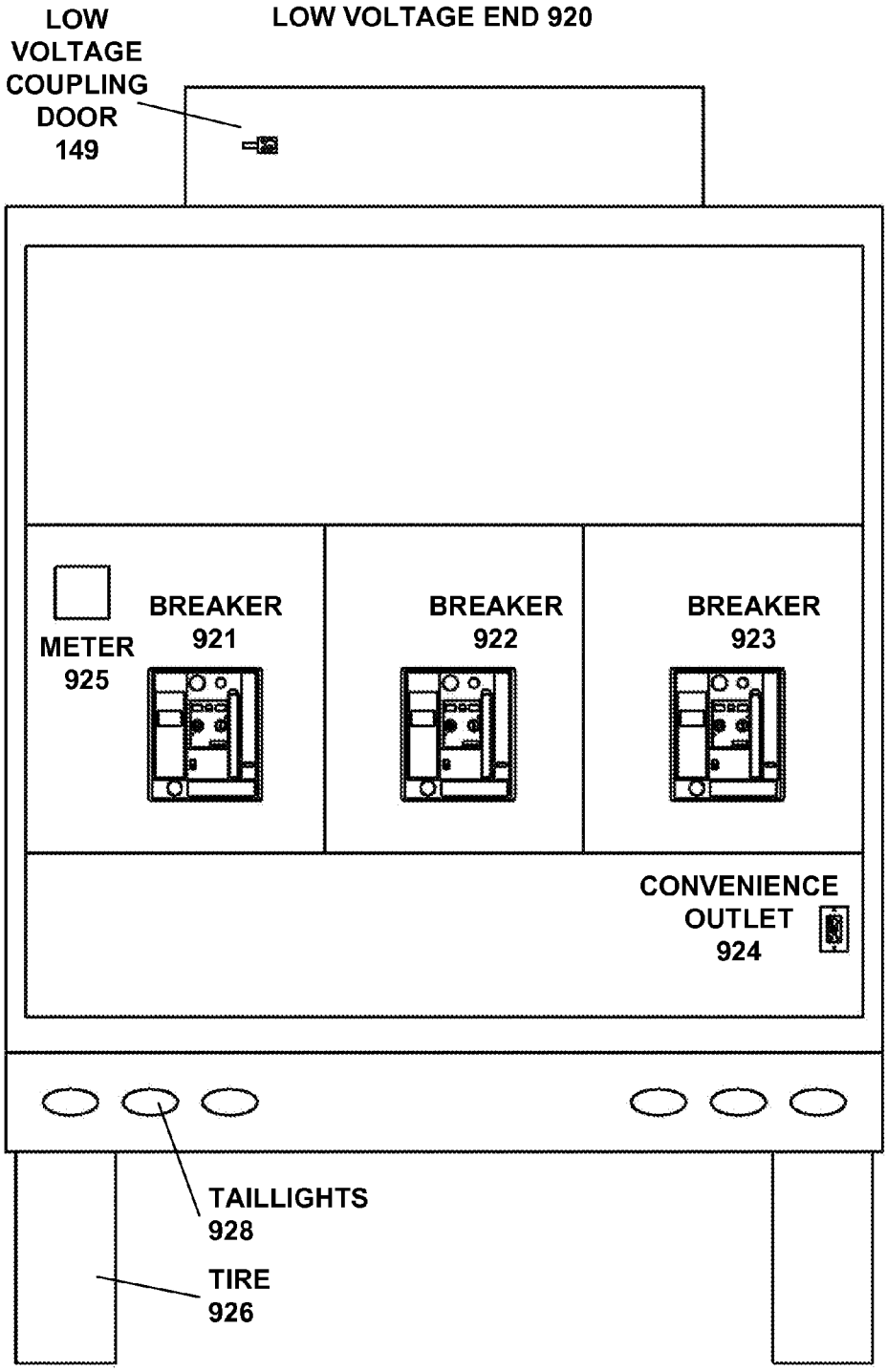
FIG. 13 illustrates a view of behind doors on a low voltage end of the housing for the portable apparatus according to an embodiment of the present inventions.

FIG. 13 illustrates a view of the low voltage end 920 of the housing for the portable apparatus according to an embodiment of the present inventions. The trailer is pulled on wheels such as tire 926 and displays taillights 928. Insulated case breakers 921, 922 and 923 are illustrated on the low voltage end behind the exterior door.

A low voltage coupling door 149 on the roof covers low voltage couplings or outlets such as 170 or 270. Although an interlock is unneeded on the low voltage couplings or outlets, a mechanical or captive key can be provided on a lock to the low voltage coupling door 149.

Basic metering can be provided by a meter on the low voltage end behind the exterior door. The meter preferably measures amperage, voltage, and frequency in kW, kVA, kVar and kWh, kVarh to 0.2% current and voltage accuracy and to 0.5% power accuracy. The meter 925 can be a Diris A20 meter by Socomec with a bright blue LED meter display 925. A low voltage GFCI convenience outlet 924 is accusable as illustrated.

A 12 volt DC electric system powers temporary LED lighting and a 120 VAC inverter for a power meter. This will keep the voltage regulated for the power meter and advise of any unsafe voltage conditions. The DC system also powers the running lights on the trailer. A relay switches between battery and trailer connection when trailer power is applied. An onboard battery charger with standard NEMA 5-15P 120 VAC inlet shall keep the battery in a satisfactory condition. The 120 VAC external power shall also operate a dehumidifier preferably provided by a 500 watt enclosure heater and fan to keep the enclosure dry during cold months when condensation could become an issue.

Advanced communications can be provided by wireless internet over cellular, a GPS location, meter screens exportable to spreadsheets, real time information from any computer, firewalls can be included for VPN and can send e-mail warnings.

More than one portable apparatus of the preferred embodiment can be deployed in parallel to increase capacity. Thus the transformer 150 can accommodate paralleling is acceptable with calculation. The embodiments described herein offer the best of flexibility in selecting voltage levels and also an ability to overload by 125% for up to 4 hours.

The portable apparatus of the preferred embodiment is bi-directional in that the portable apparatus can both be fed by medium voltages to produce low voltages or be fed by low voltages to provide medium voltages. This is useful not only for absorbing back voltages and inductive load surges but also now that electric customers can generate their own power such as using renewable energy such as photovoltaic solar and wind, sell it back to an electrical utilities. Thus the transformer 150 can accommodate back-feeding.

A portable apparatus such as the self-contained transformer trailer of present inventions, known as the Jack Jumper, has many benefits and advantages. It is an ideal alternative to emergency generator power, fully enclosed design, built for utilities, with significant cost savings. It is an excellent preventative maintenance tool, and opportunity to improve CAIDI scores and safety.

In situations not requiring prime power, the portable apparatus, also referred to as the "Jack Jumper," is a very economical, quick, and green alternative to portable generators. It has been designed as a fully enclosed unit with operator safety in mind. The unit has on-board cable storage, with connectors available on the top deck or end. It is also a preventative maintenance tool where a utility or other company can schedule maintenance during business hours with paralleling to minimize outages and can repair blown lightning arrestors, replace burnt transformers and upgrade equipment with reduced outage leasing to increased customer satisfaction. It is a "Green" alternative to generators with no emissions from internal combustion engines, reduced consumption of fossil fuels and low noise, at around 65-75 dB.

Its safety advantages include dead front type construction, connections through cam type or plug in connectors, padlockable voltage testing points, padlockable main doors and mechanically interlocked secondary breakers. Also as a seamless uninterrupted power supply provides less outages, quicker repairs during outages, responsive customer service and good value.

Applicants define the terms medium voltage and low voltage in accordance with the usage in the electrical power and electrical utilities industries wherein, generally speaking, a medium voltage is roughly in the hundreds of volts and a medium voltage in roughly in the thousands of volts. Specifically it is believed the industry definitions are low voltage is about 600 volts and lower, medium voltage is from about 1000 volts to about 38000 volts and high voltage is above about 38000 volts.

Any letter designations such as (a) or (b) etc. used to label steps of any of the method claims herein are step headers applied for reading convenience and are not to be used in interpreting an order or process sequence of claimed method steps. Any method claims that recite a particular order or process sequence will do so using the words of their text, not the letter designations.

Unless stated otherwise, terms such as "first" and "second" are used to arbitrarily distinguish between the elements such terms describe. Thus, these terms are not necessarily intended to indicate temporal or other prioritization of such elements.

Any trademarks listed herein are the property of their respective owners, and reference herein to such trademarks is generally intended to indicate the source of a particular product or service.

Although the inventions have been described and illustrated in the above description and drawings, it is understood that this description is by example only, and that numerous changes and modifications can be made by those skilled in the art without departing from the true spirit and scope of the inventions. Although the examples in the drawings depict only example constructions and embodiments, alternate embodiments are available given the teachings of the present patent disclosure.

What is claimed is:

1. A portable apparatus for voltage transformation capable of temporarily augmenting a power transformer, comprising:

a transformer comprising a first medium voltage primary winding, a second medium voltage primary winding and a low voltage secondary winding;

a plurality of medium voltage electrical power input couplings capable of temporarily coupling with medium voltage power;

medium voltage circuit protection devices operatively coupled between the medium voltage electrical power input couplings and the first and second medium voltage primary windings of the transformer;

an interlocked switch operatively coupled between the medium voltage electrical power input couplings and the first and second medium voltage primary windings of the transformer to selectably couple the medium voltage electrical power input couplings to the medium voltage primary windings of the transformer via the medium voltage circuit protection devices such that only one medium voltage primary winding of the transformer is coupled at a time to the medium voltage electrical power input couplings; and a low voltage circuit protection device operatively coupled to the low voltage secondary windings for providing low voltage power.

2. A portable apparatus according to claim 1, wherein the interlocked switch further comprises a captive key system to prevent more than one secondary winding from being simultaneously connected.

3. A portable apparatus according to claim 1, further comprising an interlocked couplings door arranged to lockably cover the medium voltage electrical power input couplings such that the interlocked couplings door can be open when no medium voltage primary winding of the transformer is coupled to the medium voltage electrical power input couplings.

4. A portable apparatus according to claim 3, wherein the interlocked switch and the interlocked couplings door each comprise a captive key system to prevent more than one secondary winding from being simultaneously connected and the interlocked couplings door from being unlocked when a medium voltage primary winding of the transformer is coupled to the medium voltage electrical power input couplings.

5. A portable apparatus according to claim 1, wherein the medium voltage circuit protection devices comprise fuses; and wherein the portable apparatus further comprises an interlocked fuse door arranged to lockably cover the fuses such that the fuse door can be open when no medium voltage primary winding of the transformer is coupled to the medium voltage electrical power input couplings.

6. A portable apparatus according to claim 5, wherein the interlocked switch and the interlocked fuse door each comprise a captive key system to prevent more than one secondary winding from being simultaneously connected and the interlocked fuse door from being unlocked when a medium voltage primary winding of the transformer is coupled to the medium voltage electrical power input couplings.

7. A portable apparatus according to claim 1, wherein the medium voltage circuit protection devices comprise fuses, each of the fuses corresponding to respective ones of the first and second medium voltage primary windings of the transformer.

8. A portable apparatus according to claim 7, further comprising an interlocked fuse door arranged to lockably cover the fuses such that the fuse door can be open when no medium voltage primary winding of the transformer is coupled to the medium voltage electrical power input couplings.

9. A portable apparatus according to claim 8, wherein the interlocked switch and the interlocked fuse door each comprise a captive key system to prevent more than one secondary winding from being simultaneously connected and a door from being unlocked when a medium voltage primary winding of the transformer is coupled to the medium voltage electrical power input couplings.

10. A portable apparatus according to claim 8, further comprising an interlocked couplings door arranged to lockably cover the medium voltage electrical power input couplings such that the interlocked couplings door can be open when no medium voltage primary winding of the transformer is coupled to the medium voltage electrical power input couplings.

11. A portable apparatus according to claim 10, wherein the interlocked switch, the interlocked fuse door and the interlocked couplings door each comprise a captive key system to prevent more than one secondary winding from being simultaneously connected and a door from being unlocked when a medium voltage primary winding of the transformer is coupled to the medium voltage electrical power input couplings.

12. A portable apparatus according to claim 1, wherein the first and second medium voltage primary windings of the transformer have different voltages; and wherein the medium voltage circuit protection devices comprise fuses, each of the fuses having voltage and current ratings corresponding to the different voltages of respective ones of the first and second medium voltage primary windings of the transformer.

13. A vehicular trailer according to claim 4, further comprising a vehicular trailer for portably transporting the portable apparatus.

14. A portable apparatus according to claim 1, wherein the primary windings of the transformer comprise taps; and wherein the portable apparatus further comprises a tap switch operatively coupled to the interlocked switch and the taps to trim a primary voltage by selectively coupling a tap to the medium voltage electrical power input couplings.

15. A vehicular trailer according to claim 1, further comprising a vehicular trailer for portably transporting the portable apparatus.

16. A portable apparatus according to claim 1, wherein the transformer further comprises a plurality of low voltage secondary windings;

wherein the low voltage circuit protection devices comprise a plurality of low voltage breakers associated with corresponding ones of the plurality of low voltage secondary windings; and wherein the portable apparatus further comprises a low voltage interlock operatively coupled between the plurality of low voltage breakers to prevent more than one breaker from being engaged simultaneously.

17. A portable apparatus according to claim 16, wherein the low voltage interlock comprises a mechanical cable interlock coupled between the plurality of low voltage circuit protection devices.

18. A portable apparatus according to claim 1, wherein the transformer further comprises a plurality of low voltage secondary windings;

wherein a plurality of the low voltage circuit protection devices correspond with ones of the plurality of low voltage secondary windings; and wherein the portable apparatus further comprises a low voltage interlock operatively coupled between the low voltage circuit protection devices to prevent more than one breaker from being engaged simultaneously.

19. A portable apparatus according to claim 18, wherein the low voltage interlock comprises a mechanical cable interlock coupled between the plurality of low voltage circuit protection devices.

20. A portable apparatus according to claim 1, wherein the portable apparatus further comprises a low voltage dehumidifier operatively disposed to dehumidify an enclosure of the portable apparatus.

* * * * *